US007905367B2

(12) United States Patent
Jessberger

(10) Patent No.: US 7,905,367 B2
(45) Date of Patent: Mar. 15, 2011

(54) OIL PAN FOR AN INTERNAL COMBUSTION ENGINE

(75) Inventor: Thomas Jessberger, Asperg (DE)

(73) Assignee: Mann + Hummel GmbH, Ludwigsburg (DE)

( * ) Notice: Subject to any disclaimer, the term of this patent is extended or adjusted under 35 U.S.C. 154(b) by 221 days.

(21) Appl. No.: 11/657,075

(22) Filed: Jan. 24, 2007

(65) Prior Publication Data

US 2007/0170390 A1 Jul. 26, 2007

(30) Foreign Application Priority Data

Jan. 24, 2006 (DE) ..... 20 2006 001 142 U

(51) Int. Cl.
*F16K 31/44* (2006.01)

(52) U.S. Cl. ..... 215/356; 220/290; 251/215; 251/346

(58) Field of Classification Search ..... 251/341, 251/343, 345, 346, 185; 220/290, 297, 300, 220/301; 215/356; 184/1.5
See application file for complete search history.

(56) References Cited

U.S. PATENT DOCUMENTS

| | | | | |
|---|---|---|---|---|
| 4,717,119 | A * | 1/1988 | Trin | 251/144 |
| 4,938,314 | A * | 7/1990 | Sitzler et al. | 184/1.5 |
| 5,096,158 | A * | 3/1992 | Burdick et al. | 251/144 |
| 5,107,808 | A * | 4/1992 | Mahn et al. | 123/195 C |
| 5,246,202 | A * | 9/1993 | Beamer | 251/252 |
| 6,206,344 | B1 * | 3/2001 | Takahara | 251/149.6 |
| 6,905,040 | B2 * | 6/2005 | Hilger et al. | 220/301 |
| 2005/0258392 | A1 * | 11/2005 | Pliml | 251/345 |

FOREIGN PATENT DOCUMENTS

EP 1 041 253 B1 10/2000

* cited by examiner

*Primary Examiner* — John Bastianelli

(57) ABSTRACT

An oil pan having a drain mechanism (10) that comprises an adjustable valve body (11) which is introduced into a drain opening (13) in an oil pan wall and which is adjustable between a closed position and an open position. A sealing member (12) made of a flexible material is arranged on the valve body (11) of the drain mechanism (10) for closing the drain opening (13) in the wall of the oil pan (1) when the valve body is in the closed position, and the valve body (11) when in the closed position is secured against the wall of the oil pan (1) by a closing element, and the sealing member (12) is held in the closed position by the closing element.

9 Claims, 4 Drawing Sheets

OIL PAN FOR AN INTERNAL COMBUSTION ENGINE

BACKGROUND OF THE INVENTION

The present invention relates to an oil pan, in particular for an internal combustion engine, having a drain mechanism comprising a valve body which is inserted into a drain opening in an oil pan wall and which is adjustable between closed and open positions.

Oil pans of this type, which are arranged on the underside of an internal combustion engine, must be designed to be stable to withstand high forces, and also to withstand high mechanical forces to which they may be subjected, for example, from a stone strike or from the vehicle scraping the ground. There are also known embodiments of oil pans made of metal or even a one-piece injection-molded part made of polyamide or polypropylene, as described in published European patent application no. EP 1,041,253. To be able to drain the oil out of the oil pan, a drain opening is provided in the bottom of the pan which can be closed by an adjustable closing element. In the case of oil pans made of metal, this closing element may be designed as an oil drain screw which is screwed into the drain opening under pressure via a copper gasket, so that a leak-proof condition is established. In the case of oil pans made of synthetic resin material, the required imperviousness can hardly be established merely by a screw connection of the oil drain plug to the wall of the oil pan because only a limited introduction of force is possible for strength reasons, but this is not sufficient to achieve reliable fluid-tightness. Instead, threaded inserts which are inserted into the opening to be sealed may be used. However, such measures are associated with a relatively great complexity and cost. Furthermore, there is the risk of the threaded insert being ripped out if it is subjected to a force which is too high.

SUMMARY OF THE INVENTION

It is an object of the invention to provide an improved oil pan with a drain mechanism.

Another object of the invention is to provide an oil pan drain mechanism having a simple design suitable for use in oil pans having a relatively thin wall or in oil pans made of synthetic resin material.

These and other objects are achieved in accordance with the present invention by providing an oil pan for an internal combustion engine, having a drain mechanism which is adjustable between a closed position and an open position and which comprises an adjustable valve body insertable into a drain opening in an oil pan wall, wherein a sealing member made of a flexible material is arranged on the valve body of the drain mechanism for sealing the drain opening in the oil pan wall when the valve body is in the closed position, and wherein the valve body in the closed position is fixed by a closing element to the wall of the oil pan, and the sealing member is held in the closed position by the closing element. Advantageous preferred embodiments and optional features are described hereinafter.

In an oil pan according to the present invention, the drain mechanism comprises an adjustable valve body which is to be adjusted between a closed position that seals the drain opening in the oil pan wall and an open position that releases the drain opening. A sealing member made of a flexible material is provided on the valve body of the drain mechanism, sealing the drain opening when the valve body is in the closed position. In addition, the valve body is secured in its closed position with the aid of a closing element on the wall of the oil pan, and the closing element holds the sealing member which is mounted on the valve body in the closed position.

This embodiment has the advantage that a thread is not required in the wall of the oil pan bordering the drain openings, so it is possible to use oil pans made of metal having very thin walls as well as oil pans made of synthetic resin material. The absence of a thread in the drain opening represents a considerable simplification from a design standpoint.

In accordance with one advantageous embodiment, the valve body executes an axial lifting movement during the transfer movement between its closed position and its open position, this axial movement being combined with a rotational movement, whereby the transfer between the closed position and the open position of the valve body is advantageously implementable with the help of simple control elements and can be performed from outside of the oil pan in particular. The valve body may be moved manually—optionally with the help of a control element—into the open position by an external component, e.g., a tool, thereby opening the drain opening and allowing the oil to escape from the pan. For a tight fit in the drain opening, it may be advantageous here for the sealing member to be arranged in the area of the end face of the valve body and optionally designed in the form of a cone, so that a secure tight fit is supported. To open the drain opening, the valve body including the sealing member arranged on it is lifted out of the sealing position. The opening movement of the valve body is advantageously a lifting movement superimposed on a rotational movement.

The closing element which secures the valve body in the closed position on the wall of the oil pan may be constructed, for example, as a protrusion or projecting finger on the wall of the oil pan, which extends into a recessed track on the valve body. The recessed track advantageously comprises a horizontal section and an oblique section with a component in the direction of the longitudinal axis of the valve body. The horizontal section corresponds to the catch position of the valve body in its sealing position, i.e., closed position, whereas the section running obliquely creates the lifting motion of the valve body in the axial direction. The recessed track sections running across the lifting movement may also be combined with a roughened surface structure in the walls bordering the recessed track to improve the self-locking effect.

BRIEF DESCRIPTION OF THE DRAWINGS

The invention will be described in further detail hereinafter with reference to illustrative preferred embodiments shown in the accompanying drawing figures, in which.

DETAILED DESCRIPTION OF PREFERRED EMBODIMENTS

Figure 1:
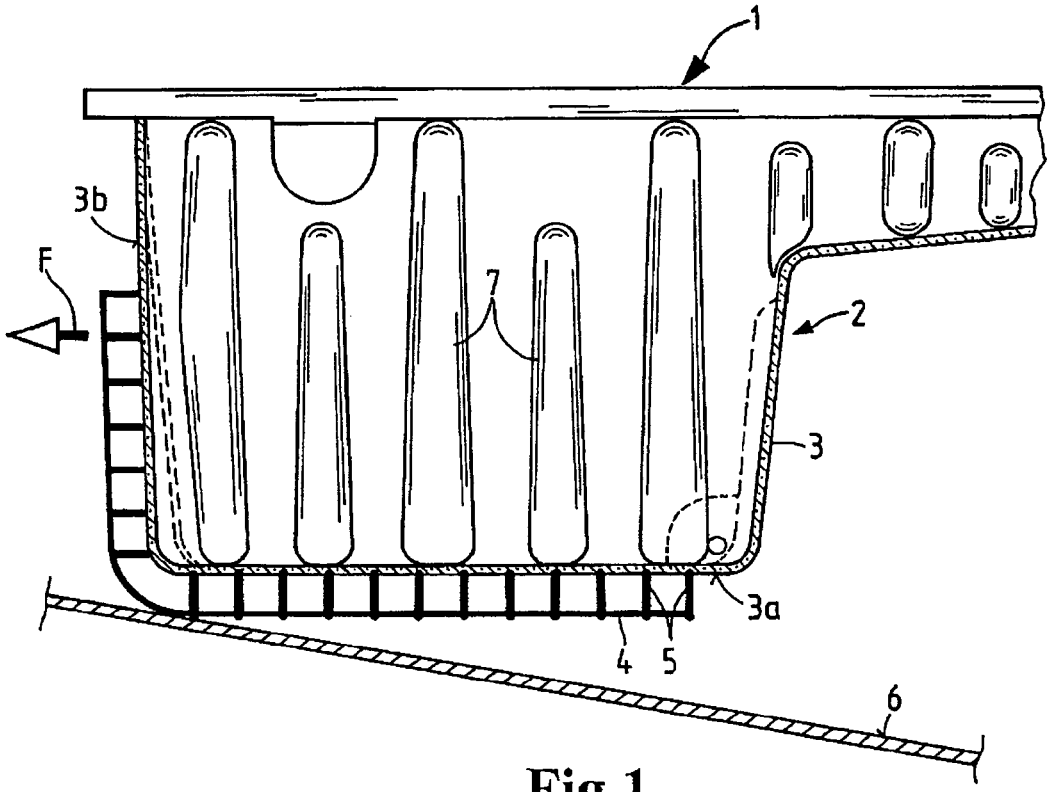
FIG. 1 shows an oil pan for the internal combustion engine of a motor vehicle in a side view, in which the outside wall of the oil pan in the area of the bottom of the pan and the side walls situated at the front in the direction of travel are surrounded by a protective shell connected by a plurality of spacer elements to the outside wall.

In the figures, corresponding components are identified by the same reference numerals.

The oil pan 1 for an internal combustion engine of a motor vehicle as illustrated in FIG. 1 has an oil pan housing 2 made of synthetic resin material manufactured, in particular, by an injection molding process. The outside wall 3 of the oil pan housing 2 comprises a pan bottom 3*a* at the bottom and peripheral side walls 3*b*. The pan bottom 3*a* and the side walls 3*b*, which are at the front in the forward direction F of the vehicle, are surrounded by a protective wall and/or shell 4 which is constructed as a separate component and is connected to the pan bottom 3*a* and/or the front side wall 3*b* by spacer elements 5. The spacer elements 5 ensure that the protective shell 4 is spaced a distance from the outside wall 3 of the oil pan housing 2, so that an intermediate space is formed between the outside wall 3 and the protective shell 4. The protective shell 4 and the spacer elements 5 advantageously also may be made of synthetic resin material.

According to one preferred embodiment, the protective shell 4 including the spacer elements 5 is integrally molded on the outside wall 3 of the oil pan. The protective shell 4 is concentric with the outside wall 3 of the oil pan. Because of the distance between the protective shell 4 and the outside wall 3, this ensures that in the case of a stone impact or if the oil pan comes in contact with uneven ground, as shown in FIG. 1, initially only the outer protective shell 4 is damaged, whereas the outside wall 3 of the oil pan remains undamaged. High forces acting on the protective shell 4 are distributed uniformly over the outside wall of the oil pan via the plurality of spacer elements 5 which are constructed as struts or ribs, so that high local force peaks acting on the protective shell 4 are uniformly distributed across the entire outside wall of the oil pan in the manner of a surface load inasmuch as the protective shell 4 extends around the oil pan.

If desired, additional ribs 7 may be constructed on the outside wall 3, reinforcing the outside wall and providing additional stability. These ribs 7 are arranged in the area of the side walls 3*b* as well as advantageously being arranged directly on the outside wall 3 in the area of the pan bottom 3*a*.

Figure 2:
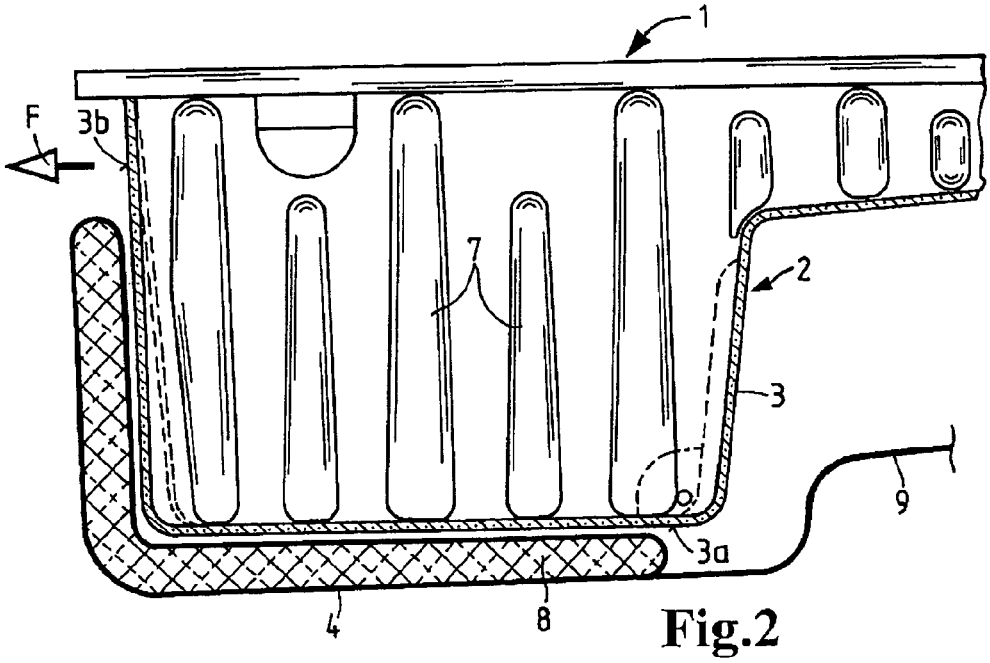
FIG. 2 is a diagram corresponding to that of FIG. 1, except that a protective shell which is part of an underbody, is provided with an elastomeric damping element in the intervening space between the protective shell and the outside wall of the oil pan.

In the illustrative embodiment shown in FIG. 2, the protective shell 4 constitutes a component of an underbody cover 9, which is provided on the underside of a vehicle. In the area situated at the front in the direction of travel F, the protective shell 4 extends around the front side wall 3*b*. Furthermore, the underbody 3*a* of the outside wall 3 of the oil pan is also surrounded.

The protective shell 4 is spaced a distance from the outside wall 3, with a damping element 8 introduced into the intervening space between the outside wall 3 and the protective shell 4. The damping element 8 may be made, in particular, of an elastomeric material, and is fixedly connected to the protective shell 4. The underbody cover 9 that is held on the vehicle, including the protective shell 4 forming the front area of the underbody cover, is advantageously not joined directly to the oil pan 1 but instead is held on another component of the motor vehicle, and because of its inherent stability is held in a fixed position in relation to the outside wall 3 of the oil pan 1. The damping element 8 also advantageously does not have a direct connection to the outside wall 3 of the oil pan.

In accordance with an alternative embodiment, however, it may also be advantageous to connect the damping element 8 to the outside wall 3, e.g., by adhesive bonding. Additionally or alternatively, it may be appropriate to provide connecting elements for additional connection of the protective shell 4 to the outside wall 3 of the oil pan 1.

Figure 3:
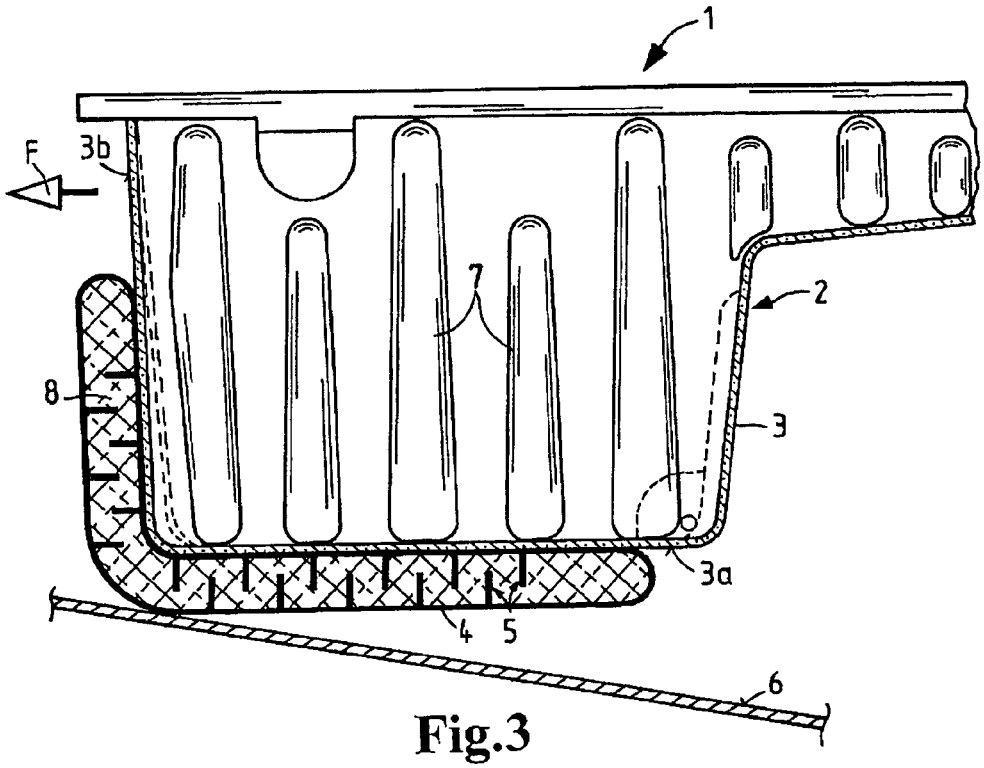
FIG. 3 depicts another illustrative embodiment in which the protective shell is connected to the outside wall of the oil pan via the damping element, and in which spacer elements protrude into the damping element for stabilization, but do not penetrate through the damping element.

In the illustrative embodiment depicted in FIG. 3, the protective shell 4 is constructed as a separate independent component which is connected directly to the outside wall 3 of the oil pan 1. The connection between the protective shell 4 and the outside wall 3 is accomplished via the elastomer damping element 8, which is situated on the side of the protective shell 4 facing the oil pan 1. In addition, spacer elements 5 may also be provided, but as shown in the illustrative embodiment according to FIG. 3, they do not completely bridge the distance between the protective shell 4 and the outside wall 3 and thus they do not penetrate completely through the damping element 8, but instead merely protrude into the damping element. The spacer elements 5 are arranged alternately on the protective shell 4 and the bottom 3*a* of the pan and front side wall 3*b* of the outside wall.

The connection of the protective shell 4 to the oil pan 1 is accomplished exclusively via the damping element 8, which is advantageously adhesively bonded to the outside wall 3 of the oil pan in this illustrative embodiment. Only in the case of a strong external influence on the protective shell 4 in the direction of the oil pan 1 and a resulting compression of the damping element 8 do the spacer elements 5, which do not penetrate completely through the damping element 8, have the task of absorbing additional supporting forces as soon as the protective shell 4 has approached the outside wall to such an extent that the spacer elements 5 are in contact with the opposite component. Additional spacer elements may optionally also be provided, joining the protective shell 4 directly to the outside wall 3 of the oil pan.

Figure 4:
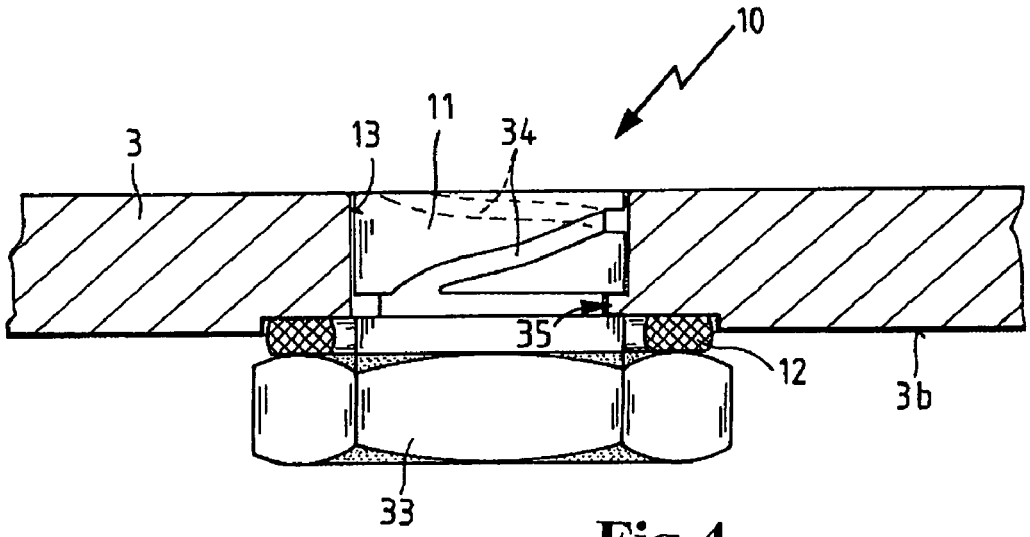
FIG. 4 is a sectional view through the pan bottom having a drain mechanism.

FIG. 4 shows a section through the pan bottom 3*a* of the oil pan with a drain opening 13 introduced into the pan bottom to be closed by an adjustable drain mechanism 10. The drain mechanism 10 surrounds a valve body 11, which can execute an opening and closing movement in order to open or close the drain opening 13. In FIG. 4, the valve body 11 is shown in its sealing position, i.e., closed position. A sealing member 12 made of a soft flexible material is arranged on the valve body 11, for sealingly closing the drain opening 13 when the valve body 11 is in the closed position.

Figure 5:
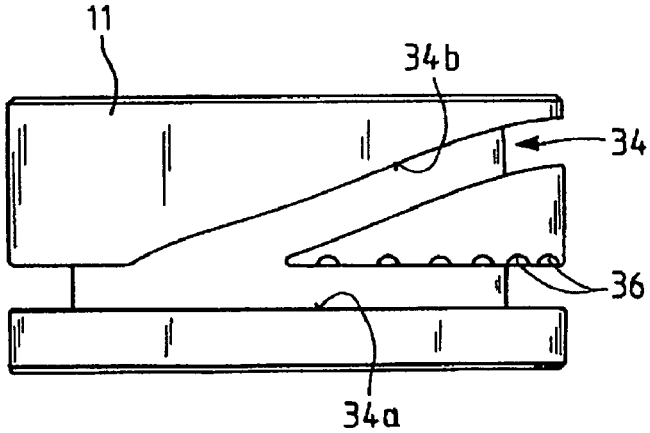
FIG. 5 is an individual view showing the valve body of the drain mechanism according to FIG. 4.

The valve body 11 in the illustrative embodiment according to FIGS. 4 and 5 is held in the sealing position with the help of a closing element. The closing element comprises a recessed track 34, which is provided in the outer surface of the valve body 11, and a projecting finger 35, which engages in the recessed track 34 and is part of the wall of the pan bottom. This projecting finger 35 extends radially inward in the drain opening 13.

The recessed track 34 comprises a section 34*a* which extends horizontally and represents the catch position of the valve body 11 in its sealing position, i.e., closed position, as well as a section 34*b*, which extends obliquely and deviates from the horizontal section and is associated with the lifting movement of the valve body. If the valve body 11 moves due to a combination of a rotational and lifting movement in such a way that the projecting finger 35 initially moves horizontally along the section 34*a* of the recessed track 34 and then moves obliquely along the additional section 34*b*, then a lifting movement for opening and closing the drain opening 13 is achieved automatically.

The sealing member 12 in the illustrative embodiment according to FIG. 4 is constructed as a sealing ring which is arranged between the outside of the pan bottom 3*b* and a head 33 fixedly connected to the valve body 11. In the locked position, i.e., the sealing position of the valve body 11, the sealing ring 12 is compressed between the head 33 and the outside of the pan bottom 3*b*.

Due to the horizontally extending section 34*a*, the sealing ring 12 is not compressed to a greater extent even when the valve body 11 is rotated further beyond the required end position. Therefore, the sealing ring 12 is not exposed to high stresses which could lead to damage.

As shown by the enlarged diagram of FIG. 5, the lower horizontal section 34*a* of the recessed track 34 is bordered by a wall in which a roughened surface structure 36 is created to increase the self-locking effect. If the projecting finger 35 is in contact with this surface structure 36, increased friction occurs, counteracting any inadvertent, unintentional opening of the valve body 11. The horizontal section of recessed track 34 extends radially completely around an outside surface of the valve body 11, thereby forming an endless horizontal track 34 on the valve body 11.

Figure 6:
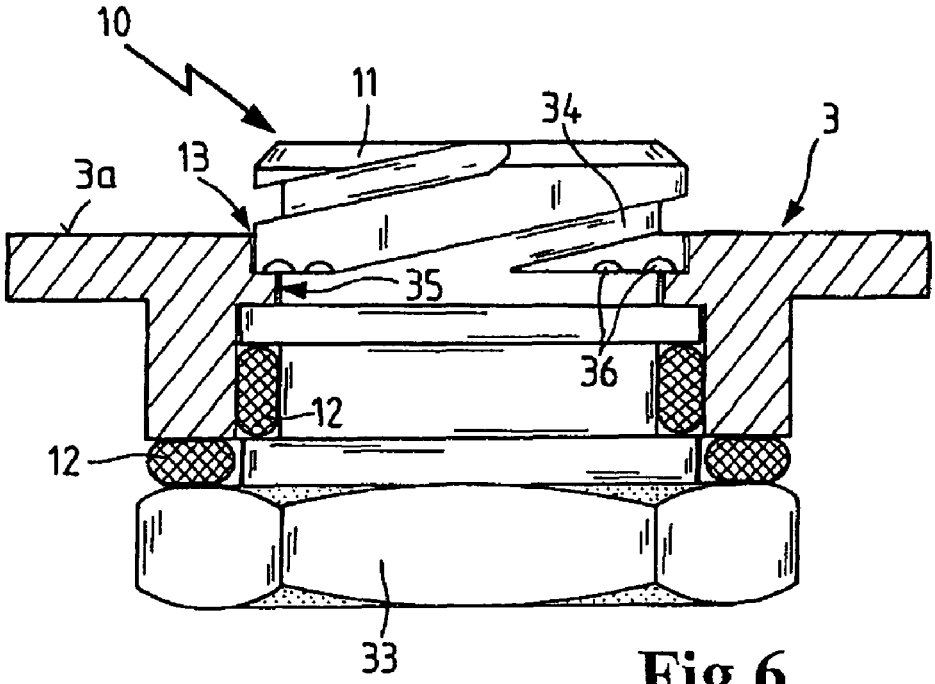
FIG. 6 is a view of a drain mechanism corresponding to that in FIG. 4, except that it has a second sealing ring forming a radial seal.

The construction of the drain mechanism 10 depicted in FIG. 6 corresponds substantially to that of FIG. 4, except that a total of two sealing rings 12 are provided between the outside wall 3 and the housing and the valve body 11 and/or the head 33. A first sealing ring 12 is in axial contact between a supporting shoulder on the head 33 and an end face of a pot-shaped protuberance in the outside wall 3. The second sealing ring 12 is disposed radially around the lateral surface of the valve body 11, transmitting sealing forces between the valve body 11 and the inside of the pot-shaped protuberance in the radial direction.

In addition, the outside wall 3 has two projecting fingers 35 opposite one another. Each projecting finger 35 engages in another obliquely extending section 34*b*. Thus the drain mechanism 10 has two obliquely extending sections 34*b* which are offset by 180° with respect to one another and open in a joint horizontal section 34*a*.

Figure 7:
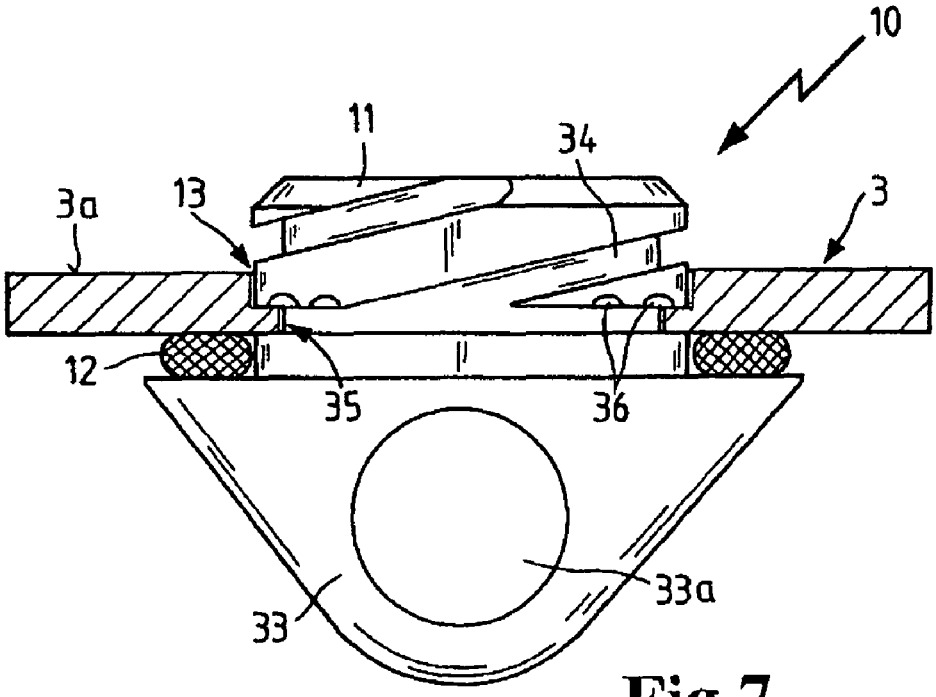
FIG. 7 shows another drain mechanism corresponding to that in FIG. 4, but with a head designed as a manually operable handle on the valve body.

FIG. 7 shows another drain mechanism 10 which is similar to the drain mechanisms illustrated in FIGS. 4 and 6. However, instead of a hexagonal head, the head 33, which is connected to the valve body 11, is constructed as a manually operable handle, so that use of a tool for opening and closing the valve body may be omitted. In addition, an opening 33*a* is also created in the head 33 into which a lever may be inserted, if necessary, for applying a high torque in order to open or close the valve mechanism.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

What is claimed is:

1. An oil pan for an internal combustion engine, said oil pan having a drain mechanism which is adjustable between a closed position and an open position and which comprises an adjustable valve body insertable into a drain opening in an oil pan wall, wherein a sealing member made of a flexible material is arranged on a head of the valve body of the drain mechanism, said sealing member sealing axially between the head and an outside surface of the oil pan wall when the valve body is in the closed position, wherein the valve body in the closed position is fixed by a closing element to the wall of the oil pan, and the sealing member is held in the closed position by the closing element, and wherein the closing element comprises a projecting finger extending radially from the wall into the drain opening, for engaging a recessed track formed in the valve body, and the recessed track has a horizontally extending section nearest to the sealing member, said horizontally extending section extending radially completely around an outer surface of said valve body forming an endless horizontal track thereon, an oblique section deviating from said horizontally extending section and extending further from the sealing member, and a roughened surface structure formed on a portion of a wall of said horizontally extending section of said recessed track, said roughened surface structure engaging with said protecting finger operative to counteract inadvertent opening of said drain mechanism.

2. An oil pan according to claim 1, wherein the sealing member comprises a sealing ring which is mounted on the valve body and which in the closed position is in sealing contact with the wall of the oil pan surrounding the drain opening.

3. An oil pan according to claim 2, wherein the sealing ring is arranged axially between the valve body and the oil pan.

4. An oil pan according to claim 2, wherein the sealing ring is arranged radially between the valve body and the oil pan.

5. An oil pan according to claim 1, wherein the valve body is constructed as a rotary closure member.

6. An oil pan according to claim 5, further comprising a manually operable handle arranged on the valve body.

7. An oil pan according to claim 1, wherein the closing element which secures the valve body in the closed position against the wall of the oil pan comprises the projecting finger on the wall of the oil pan which extends into the horizontal portion and the oblique portion of the recessed track on the valve body.

8. An oil pan according to claim 1, wherein the oil pan is made of synthetic resin material.

9. An oil pan according to claim 1, wherein a roughened surface structure is provided on the wall of the oil pan.

* * * * *